US007475479B1

(12) United States Patent
Ross

(10) Patent No.: US 7,475,479 B1
(45) Date of Patent: Jan. 13, 2009

(54) METHOD FOR ANCHORING A HOLLOW FENCE POST

(76) Inventor: Richard J. Ross, P.O. Box 121, Skippack, PA (US) 19474

( * ) Notice: Subject to any disclaimer, the term of this patent is extended or adjusted under 35 U.S.C. 154(b) by 2 days.

(21) Appl. No.: 11/520,271

(22) Filed: Sep. 14, 2006

(51) Int. Cl.
*B21D 47/00* (2006.01)
*B23P 11/00* (2006.01)

(52) U.S. Cl. ..... 29/898; 29/525.01

(58) Field of Classification Search ..... 29/525.01, 29/525.02, 525.11, 525.13, 525.14, 897; 52/296, 301; 256/1, 65
See application file for complete search history.

(56) References Cited

U.S. PATENT DOCUMENTS 3,700,213 A 10/1972 Blease ..... 256/19
4,074,893 A 2/1978 Coltrin ..... 256/21
5,803,438 A 9/1998 Blouin ..... 256/66
6,141,928 A * 11/2000 Platt ..... 52/296

* cited by examiner

*Primary Examiner*—John C Hong
(74) *Attorney, Agent, or Firm*—LaMorte & Associates P.C.

(57) ABSTRACT

A mounting assembly that is used to attach an alternate material railing system to an underlying flat surface. The mounting assembly attaches to the underlying flat surface so that the mounting assembly extends vertically upwardly from the flat surface. A hollow post from the railing system is then placed over the mounting assembly and is attached to the mounting assembly. The mounting assembly therefore acts as an intermediate connector that joins a hollow post to an underlying flat surface. The mounting assembly itself has a base plate and a vertical structure extending upwardly from the base plate. The base plate is attached to the underlying flat surface with a mechanical fastener. The hollow post of the synthetic railing system is placed over the mounting assembly, wherein the vertical structure engages the inside of the hollow post and holds the hollow post in a vertical orientation.

5 Claims, 4 Drawing Sheets

METHOD FOR ANCHORING A HOLLOW FENCE POST

BACKGROUND OF THE INVENTION

1. Field of the Invention

In general, the present invention relates to ground anchor systems that are used to anchor a railing post to an underlying surface. More particularly, the present invention relates to anchor systems that anchor hollow rail posts that are part of a plastic or aluminum railing system.

2. Prior Art Description

Building codes require that all elevated platforms, such as decks, porches, elevated patios, and the like contain a railing system that would prevent a person from accidentally falling off the elevated platform. In the past, most railing systems were made from either wood or wrought iron. If such a railing system were being placed around a wooden structure, such as a deck, the rails were simply nailed or bolted to the wooden structure. If a railing were being added to around a cement structure, the vertical rails of the railing system were typically set into the cement as the cement was being poured.

A common problem shared by wooden and iron railings is that both require continuous maintenance. Wood weathers and rots. Iron rusts. As a result, both wooden and metal railings must be periodically cleaned and/or repainted if they are intended to last.

In modern construction, the use of wood and iron railing systems is decreasing. Instead, builders are opting for alternate railing systems that are made from plastic or aluminum. Plastic railing systems have rails that are molded from vinyl or poly vinyl chloride. Such railings can be molded in any color. Consequently, the railings do not require painting. Furthermore, since the railings are plastic, they are unaffected by water, rot, insects, and rust. Aluminum railing systems are made from extruded pieces of aluminum. The aluminum can be anodized in any color. Consequently, the aluminum railings do not require painting and are unaffected by water, rot, insects and rust.

Although plastic and aluminum railings do not require periodic maintenance, they are difficult to install. Plastic posts can be damaged if they are nailed or bolted to another surface. Aluminum post can bend easily around a bolt, if the bolt is firmly tightened. Furthermore, both plastic and aluminum posts tend to fatigue and crack at the point of attachment.

Since nails and bolts create stress concentration points in a plastic and aluminum rail posts, it is preferred that nails and bolts not be used when mounting the rail posts. In the prior art, alternate material rail posts have been created that have large complex bases. The bases of the alternate material rail post are then set into cement or are buried in the ground. Alternate material posts with enlarged bases are exemplified by U.S. Pat. No. 3,700,213 to Blease and U.S. Pat. No. 5,803,438 to Blouin.

Although burying the base of an alternate material railing post in the ground or in poured concrete is effective, such mounting techniques cannot be used if the railing post is to be mounted over a slab of hard concrete.

When mounting an alternate material railing post to hard concrete, one of two prior art techniques are typically used. The first technique requires that a hole be chiseled in the concrete. The railing post is then set into the new hole and the new hole is refilled with concrete.

The second technique requires the use of steel brackets. A steel reinforcement post is bolted to the cement with L-brackets. The alternate material railing post is then placed over the steel reinforcement post. The technique of bolting a metal support post to a cement slab with L-shaped brackets is shown in U.S. Pat. No. 4,074,893 to Coltrin, entitled Fence.

Chiseling a hole in a concrete slab that is large enough to accommodate a post has obvious drawbacks. The creation of the hole is labor intensive and can permanently damage the structural integrity and aesthetics of the concrete slab. Additionally, mounting a post to a concrete slab also has problems. The L-shaped brackets used to connect the support post to the slab protrude out from the base of the synthetic post. The presence of the brackets prevents the bottom of the synthetic post from laying flush against the concrete slab. Furthermore, since the brackets are exposed, the brackets can rust and require maintenance.

A need therefore exists for a system and method of attaching an alternate material railing post to a concrete, wooden or earthen support without having to create a large hole in the support and without having to use brackets that protrude from the railing post. This need is met by the present invention as described and claimed below.

SUMMARY OF THE INVENTION

The present invention is a mounting assembly that is used to attach a plastic or aluminum railing system to an underlying flat surface. The mounting assembly attaches to the underlying flat surface so that the mounting assembly extends vertically upwardly from the flat surface. A hollow post from the plastic or aluminum railing system is then places over the mounting assembly and is attached to the mounting assembly. The mounting assembly therefore acts as an intermediate connector that joins a hollow post to an underlying flat surface.

The mounting assembly itself has a base plate and a vertical structure extending upwardly from the base plate. The base plate is attached to the underlying flat surface with at least one mechanical fastener. The hollow post of the railing system is placed over the mounting assembly, wherein the vertical structure engages the inside of the hollow post and holds the hollow post in a vertical orientation.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and method can be used to anchor many types of fence and railing posts, such as stairway railing posts, the present invention is particularly well suited for mounting railings around the periphery of an elevated platform. Accordingly, the exemplary embodiment of the invention will show applications where a railing is being attached to both a concrete platform and a wooden deck in order to set forth the best modes contemplated for the invention. Such embodiments are intended to be exemplary and should not be considered a limitation to the application of the present invention.

Figure 1:
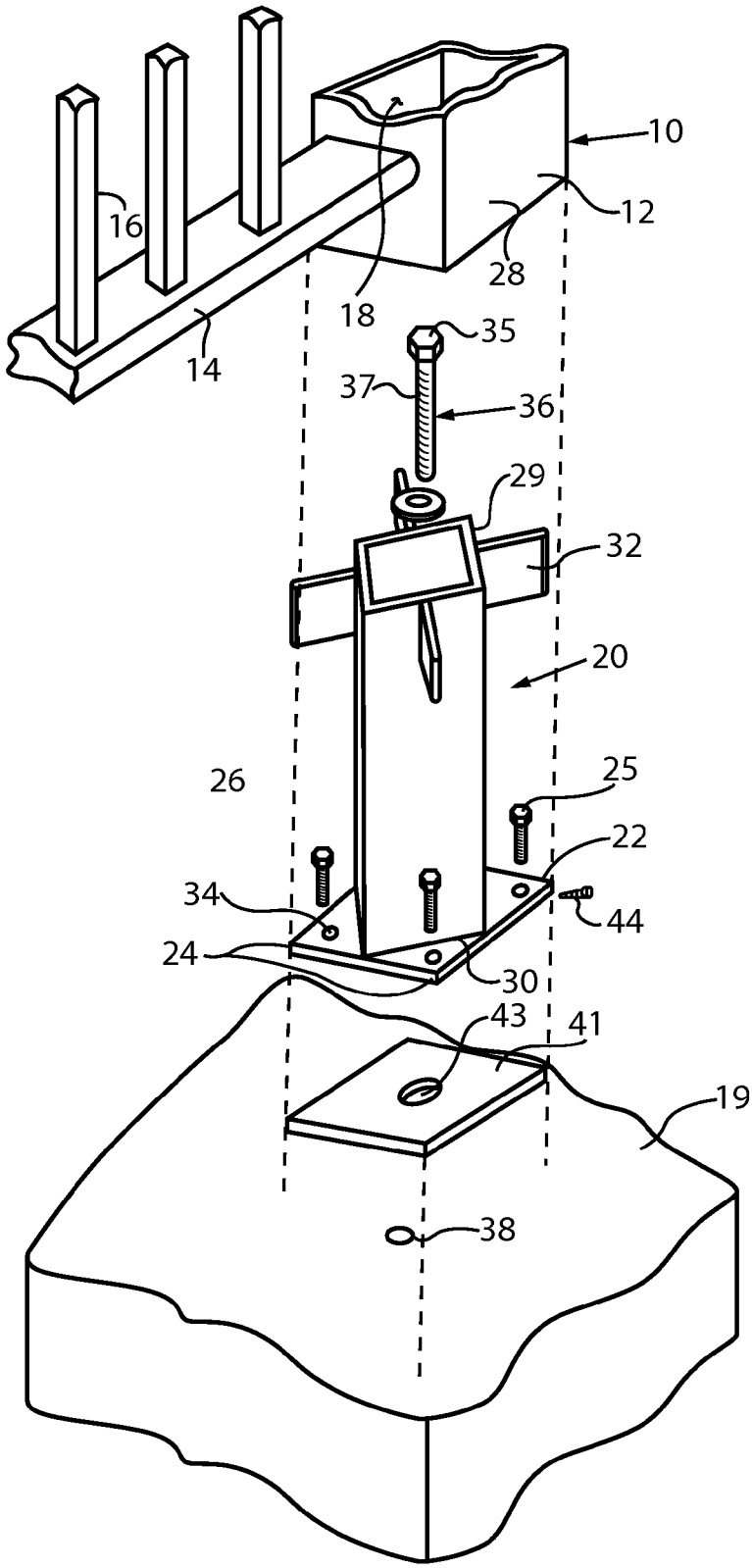
FIG. 1 shows a perspective view of an exemplary embodiment of the present invention shown in conjunction with a railing system and an underlying flat concrete surface.

Referring to FIG. 1, there is shown a typical alternate material railing system 10. The railing system 10 includes vertical posts 12, lateral rails 14 and vertical spindles 16. The vertical posts 12, lateral rails 14 and vertical spindles 16 are all molded from either plastic or aluminum. Although the lateral rails 14 and the vertical spindles 16 may be solid, the vertical posts 12 are hollow.

In the shown exemplary embodiment, the vertical posts 12 have a square profile. Consequently, the vertical posts 12 define an open interior 18 that also has a square profile. The use of a square vertical post 12 is merely exemplary. It will therefore be understood that the vertical post 12 can have a round or rectangular shape and that the open interior 18 would have a corresponding shape.

In FIG. 1, a concrete patio 19 is shown. The present invention is the mounting assembly 20 that is used to connect the vertical posts 12 of the railing system 10 to the concrete patio 19. The mounting assembly 20 has a base plate 22. The base plate 22 is sized and shaped so that it just fits into the open interior 18 of the vertical post 12. In the shown embodiment, the vertical post 12 has a square profile. Consequently, the base plate 22 is also square so that it will precisely pass into the open interior 18 of the vertical post 12 with a uniform clearance around its periphery. The base plate 22, being square, has four salient points 24 that pass into the four corners of the open interior 18. If the vertical post 12 had an open interior 18 that was round or rectangular, it will be understood that the base plate 22 would have a corresponding shape.

A tubular shaft 26 extends vertically upward from the center of the base plate 22. The tubular shaft 26 is smaller than the base plate 22 and is not wider than the base plate 22 at any point along its length. However, it is preferred that the tubular shaft 26 come close to the flat side edges 28 of the base plate 22 near the midpoint of each of the flat side edges 28. In the shown embodiment, the tubular shaft 26 is hollow along its entire length. Consequently, the tubular shaft 26 has an open top end 29 and a bottom end 30 that is sealed closed by the presence of the base plate 22. The bottom end 30 of the tubular shaft 26 is welded to the base plate 22 around its periphery. Spacer tabs 32 extend from the tubular shaft 26 proximate its open top end 29. The spacer tabs 32 radially protrude from the sides of the tubular shaft 26 and terminate at points that align with the salient points 24 of the base plate 22. It will therefore be understood that the salient points 24 of the base plate 22 are vertically aligned with the free ends of the spacer tabs 32.

Threaded leveling holes 34 are formed in the corners of the base plate 22 behind each of the salient points 24. Leveling bolts 25 are provided that thread into the leveling holes. As will later be explained in more detail, the leveling bolts 25 are adjusted within the leveling holes in order to maintain the base plate 22 in the horizontal plane.

A larger central mounting hole (not shown) is disposed in the center of the base plate 22. A primary mounting bolt 36 is provided. The primary mounting bolt 36 is passed through the mounting hole in the base plate 22. The head 35 of the primary mounting bolt 36 is welded to the base plate 22. Accordingly, the primary mounting bolt 36 is permanently affixed to the base plate 22 so that the shaft 37 of the mounting bolt 36 extends below the base plate 22 at a perpendicular to the plane of the base plate 22.

The type of mounting bolt 36 used depends upon the surface to which the mounting assembly 20 is being attached. The mounting bolt 36 can be a carriage bolt, a lag bolt or a cement bolt. In the shown embodiment, the mounting assembly 20 is being attached to a concrete patio 19. Accordingly, the mounting bolt 36 is being shown as a cement bolt.

A leveling plate 41 is provided. The leveling plate 41 is flat and is preferably made of a rust resistant metal, such as stainless steel, galvanized steel, aluminum, titanium or the like. The leveling plate 41 has the same peripheral size as does the base plate 22. Accordingly, the edges of the base plate 22 align atop the edges of the leveling plate 41. A hole 43 is disposed in the center of the leveling plate 41. The hole 43 provides access for the passage of the primary mounting bolt 36 through the leveling plate 41.

Figure 2:
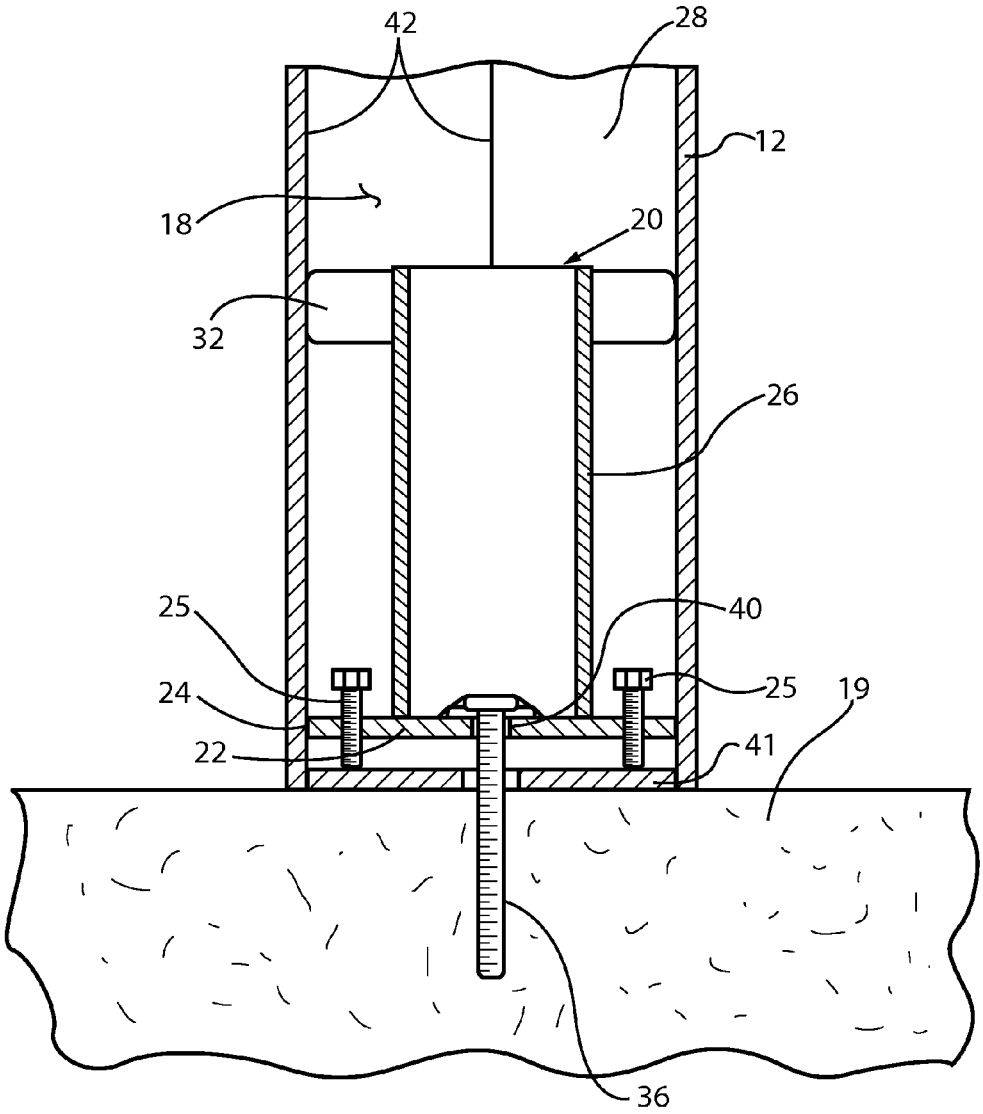
FIG. 2 shows a cross-sectional view of the components of FIG. 1 in an assembled configuration.

Referring now to FIG. 2 in conjunction with FIG. 1, it can be seen that to use the present invention mounting assembly 20, a hole 38 is first drilled into the concrete patio 19. This can be quickly accomplished using a drill with a standard masonry bit. Once the hole 38 has been drilled, the leveling plate 41 is placed over the hole 38 so that the hole 43 in the leveling plate 41 aligns with the hole 38 in the concrete patio 19.

The primary mounting bolt 36 is inserted into the hole 38 in the concrete patio 19 through the leveling plate 41. The entire mounting assembly 20 is rotated to cause the primary mounting bolt 36 to rotate and thread into the hole 38. The hole 38 in the concrete patio 19 may not be straight in the vertical plane. Accordingly, as the base plate 22 comes close to touching the leveling plate 41, the various leveling bolts 25 are applied. The leveling bolts 25 are tightened to selective depths that cause the base plate 22 of the mounting assembly 20 to lay in the horizontal plane. Furthermore, the leveling bolts 25 bias the base plate 22 of the mounting assembly 20 away from the leveling plate 41. This creates tensioning in the primary mounting bolt 36 that helps it engage the concrete patio 19 and not shake loose over time.

The leveling bolts 25 contact the leveling plate 41 and bias the leveling plate 41 away from the base plate 22 of the mounting assembly 20. The presence of the leveling plate 41 prevents the leveling bolts 25 from directly contacting concrete patio 19. This prevents the leveling bolts 25 from wearing away the concrete patio 19 and becoming loose over time.

Once the base plate 22 is affixed to the concrete patio 19 by the primary mounting bolt 36, the tubular shaft 26 extends vertically upward from the base plate 22. The open bottom end of a rail post 12 is advanced over the mounting assembly 20. The mounting assembly 20 passes into the open interior 18 of the rail post 12 until the rail post 12 contacts the concrete patio 19. Since the rail post 12 passes completely around the mounting assembly 20, the mounting assembly 20 is completely hidden by the vertical post 12. It therefore appears as though the vertical post 12 of the railing system 10 extends directly out of the concrete patio 19.

Once the vertical post 12 of the railing system 10 is set around the mounting assembly 20, there is only a small clearance between the salient points 24 of the base plate 22 and the inside corners 42 of the open interior 18 of the vertical post 12. Likewise, there is only a small clearance between the inside corners 42 of the vertical post 12 and the spacer tabs 32 that protrude from the mounting assembly 20. The small clearances from between the open interior 18 of the vertical post 12 and both the base plate 22 and spacing tabs 32 prevent the vertical post 12 from moving. Rather, once set atop the mounting assembly 20, the mounting assembly 20 holds the vertical post 12 in a fixed vertical position.

The shape of the tubular shaft 26 causes it to lay close to the middle of the flat sides edges 28 of the vertical post 12. Holes can be drilled through the flat side of the vertical post 12 and into the tubular shaft 26 along these points. A screw 44 can then be used to secure the vertical post 12 directly to the mounting assembly 20. The screw 44 bears no loading other than to prevent the vertical post 12 from being able to lift off the mounting assembly 20.

Figure 3:
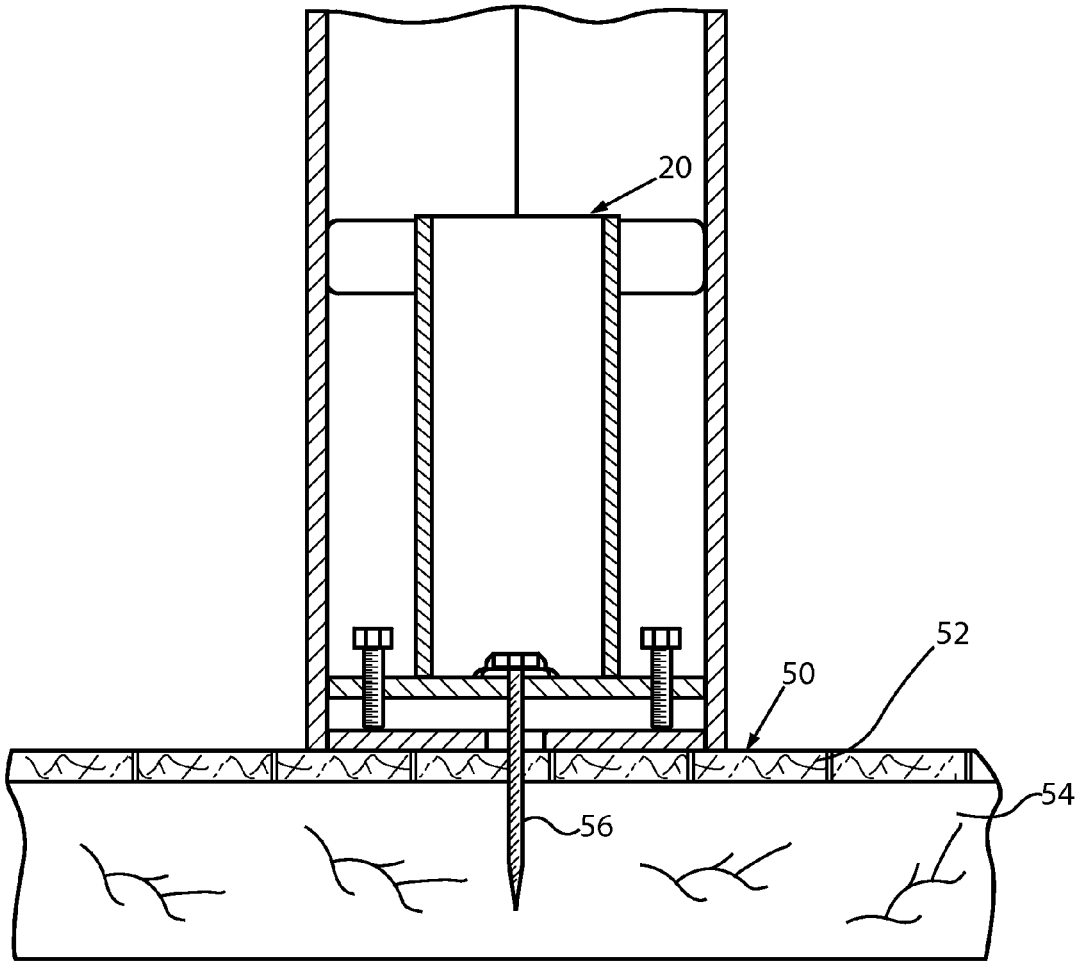
FIG. 3 shows an alternate embodiment of the present invention wherein the underlying surface is a wooded deck.

Referring to FIG. 3, the present invention mounting assembly 20 is shown being attached to the periphery of a wooden deck 50. The wooden deck 50 has wood decking 52 and a wood frame 54. The mounting assembly 20 is the same as that previously described. The only difference is that a wood lag bolt 56 is used to secure the mounting assembly 20 to the wood deck 50 rather than a cement bolt.

Figure 4:
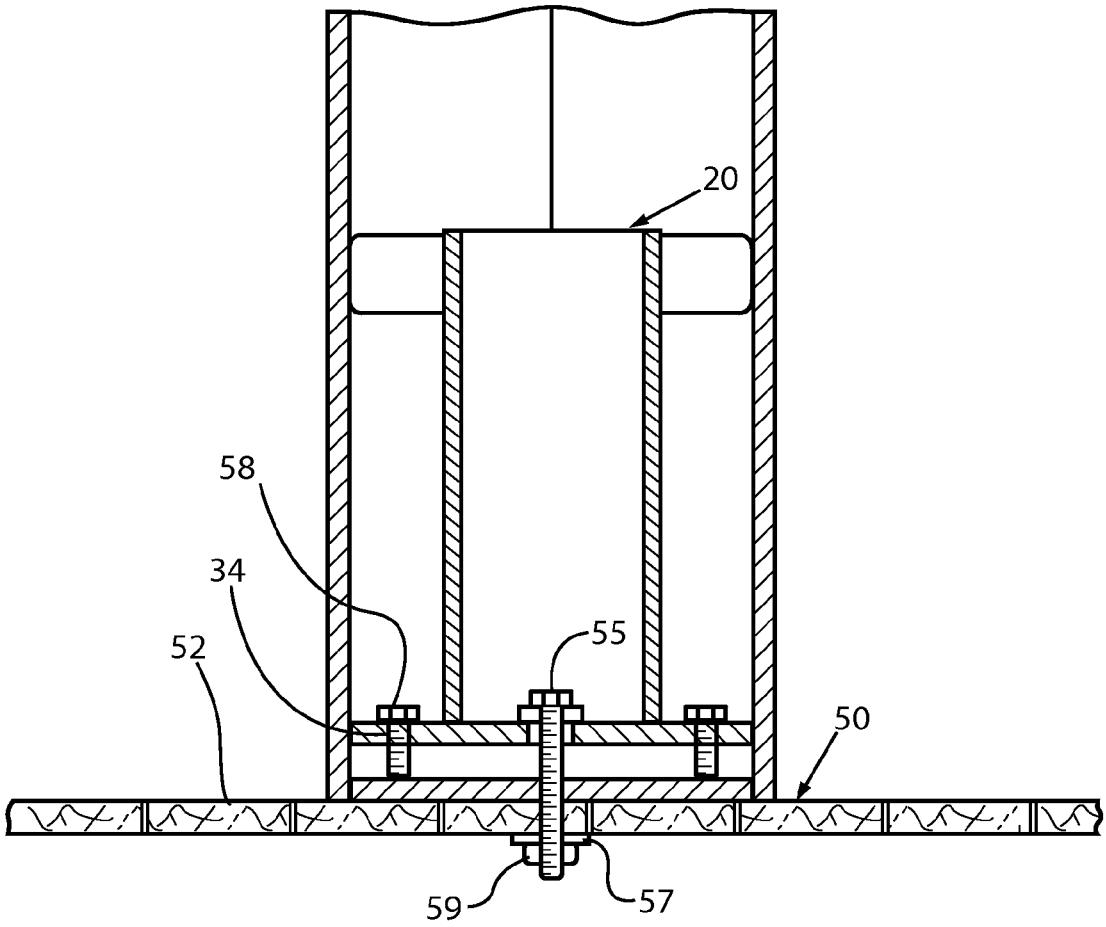
FIG. 4 shows an alternate embodiment of the present invention wherein the underlying surface is a wooded deck having no support frame.

Referring to FIG. 4, the present invention mounting assembly 20 is shown being attached to a section of wooden deck 50 that does not have any underlying framework. In such an application, the only surface to attach the mounting assembly 20 to is the decking 52. The decking 52 is typically no more than one inch thick. In the application of the mounting assembly 20 to a thin surface, such as decking or plywood, it is preferred that a lag bolt 55 be used.

A hole 53 is drilled in the wooden deck 50. The lag bolt 55 is passed through the hole 53. A larger washer 57 and nut 59 are then used to secure the lag bolt 55, therein creating a strong mechanical connection between the mounting assembly 20 and the decking 52.

It will be understood that the embodiments of the present invention that are illustrated are merely exemplary and that a person skilled in the art can make many changes to the shown embodiment. For instance, the illustrated embodiment shows a square vertical post. Consequently, the mounting assembly is square so that it fits precisely into the vertical post. It will be understood that the vertical post may be round, rectangular or any other shape. Accordingly, the profile of the mounting assembly can also be altered to correspond to the shape of the vertical post. Individual components, such as the tube shaft and spacing tab can also be varied in shape and size. All such variations, modifications and alternate embodiments are intended to be included within the scope of the present invention as claimed.

What is claimed is:

1. A method of anchoring a hollow rail post to a concrete surface, said method comprising the steps of:

providing a leveling plate having a hole formed therethrough;

providing a base plate;

providing a plurality of leveling bolts that pass through, and threadably engage, said base plate;

providing a concrete mounting bolt having a bolt head and a bolt shaft, wherein said bolt head is welded to said base plate, therein causing said bolt shaft to extend downwardly from said base plate at a perpendicular;

providing a tubular structure that is affixed to said base plate and extends upwardly from said base plate;

providing spacing tabs that radially extend from said tubular structure, wherein said base plate, said concrete mounting bolt, said tubular structure and said spacing tabs form a single rigid mounting assembly;

drilling a pilot hole in said concrete surface that is sized to receive said bolt shaft;

placing said leveling plate over said pilot hole, wherein said leveling plate rests freely on said concrete surface;

rotating said rigid mounting assembly to drive said bolt shaft into said concrete surface through said pilot hole until said base plate is proximate said leveling plate;

selectively tightening said leveling bolts to bring said leveling bolts into contact with said leveling plate and bias said tubular structure toward a vertical orientation; and placing a hollow rail post over said mounting assembly, wherein said tubular structure, said base plate and said spacing tabs pass into said hollow rail post.

2. The method according to claim 1, wherein said spacing tabs on said tubular structure terminate above said salient points of said base plate in vertical alignment with said salient points.

3. The method according to claim 1, wherein said base plate has salient points.

4. The method according to claim 2, wherein one of said leveling bolts is disposed in said base plate proximate each of said salient points.

5. The method according to claim 1, further including the step of attaching said hollow rail post to said mounting assembly with at least one mechanical fastener.

* * * * *